US011559122B2

(12) United States Patent
Sluder

(10) Patent No.: US 11,559,122 B2
(45) Date of Patent: Jan. 24, 2023

(54) SUITCASE WITH FAN AND METHOD OF USE

(71) Applicant: Don Sluder, Lake Jackson, TX (US)

(72) Inventor: Don Sluder, Lake Jackson, TX (US)

( * ) Notice: Subject to any disclaimer, the term of this patent is extended or adjusted under 35 U.S.C. 154(b) by 466 days.

(21) Appl. No.: 16/704,589

(22) Filed: Dec. 5, 2019

(65) Prior Publication Data

US 2020/0107621 A1 Apr. 9, 2020

Related U.S. Application Data

(63) Continuation of application No. 15/787,136, filed on Oct. 18, 2017, now Pat. No. 10,531,716.

(51) Int. Cl.

| | |
|---|---|
| ***A45C 5/04*** | (2006.01) |
| ***A45C 15/00*** | (2006.01) |
| ***A45C 13/28*** | (2006.01) |
| ***A45C 5/14*** | (2006.01) |

(52) U.S. Cl.

CPC ..... *A45C 5/04* (2013.01); *A45C 5/14* (2013.01); *A45C 13/28* (2013.01); *A45C 15/00* (2013.01)

(58) Field of Classification Search

CPC .. A45C 5/14; A45C 13/28; A45C 5/04; A45C 15/00; A45C 15/06; A45C 13/262; A45C 2200/20

USPC ..... 190/19, 39, 115; 150/106; 362/253

See application file for complete search history.

(56) References Cited

U.S. PATENT DOCUMENTS

| | | | | |
|---|---|---|---|---|
| 2,224,628 | A | 12/1940 | Benson | |
| 2,311,896 | A | 2/1943 | Criqui | |
| 2,397,169 | A | 3/1946 | Troller et al. | |
| 2,633,293 | A | 3/1953 | Jones | |
| 3,015,900 | A * | 1/1962 | Frink | G02B 6/007 40/564 |
| 3,802,216 | A | 4/1974 | Brandimarte | |
| D384,144 | S | 9/1997 | DuBois | |
| D387,150 | S | 12/1997 | Connahan et al. | |
| 5,694,663 | A | 12/1997 | Tserng | |
| 5,725,356 | A | 3/1998 | Carter | |
| D398,386 | S | 9/1998 | Chan | |
| D406,331 | S | 3/1999 | Chan | |
| 6,098,768 | A * | 8/2000 | Tsai | A45C 13/262 190/115 |
| 6,241,478 | B1 * | 6/2001 | Cichetti | F24F 7/007 417/63 |
| 6,386,414 | B1 | 5/2002 | Kilduff | |
| 6,425,255 | B1 | 7/2002 | Hoffman | |
| 6,454,539 | B1 | 9/2002 | Santos | |
| 6,742,684 | B2 * | 6/2004 | Oh | A45F 4/02 224/652 |
| 7,758,196 | B1 * | 7/2010 | He | F21V 21/30 362/253 |
| D635,656 | S | 4/2011 | Ghosn | |
| 8,235,686 | B2 | 8/2012 | Wark | |
| 8,740,070 | B2 | 6/2014 | Page | |
| 8,979,073 | B2 | 3/2015 | Lykins | |

(Continued)

*Primary Examiner* — Sue A Weaver

(74) *Attorney, Agent, or Firm* — Stephens Juren PLLC; Ira P Domnitz; Matthew C Juren

(57) ABSTRACT

A suitcase with portable fan. In some embodiments, the fan is attached to the telescoping arms of the suitcase. In some embodiments, the fan is removable from the telescoping arms of the suitcase. In some embodiments, the fan is embedded in the suitcase. In some embodiments the suitcase has retracting cupholders.

17 Claims, 11 Drawing Sheets

(56) References Cited

U.S. PATENT DOCUMENTS

| | | | | |
|---|---|---|---|---|
| 2003/0038007 | A1 | 2/2003 | Han | |
| 2006/0037825 | A1 | 2/2006 | Dayton | |
| 2008/0283114 | A1 | 11/2008 | Gray | |
| 2010/0051633 | A1 | 3/2010 | Porte | |
| 2010/0141153 | A1* | 6/2010 | Recker | H05B 45/357 315/149 |
| 2011/0197464 | A1* | 8/2011 | Chappell | F26B 9/003 34/232 |
| 2012/0152677 | A1 | 6/2012 | Lu | |
| 2014/0216873 | A1* | 8/2014 | Torres Montes | A47B 85/06 190/11 |
| 2014/0348666 | A1* | 11/2014 | Bonham | F04D 25/0693 417/44.11 |
| 2016/0353882 | A1 | 12/2016 | Jose | |
| 2018/0168308 | A1* | 6/2018 | Wilkin | A45C 5/14 |
| 2019/0133277 | A1* | 5/2019 | Hackett | A45C 13/30 |

* cited by examiner

SUITCASE WITH FAN AND METHOD OF USE

CROSS-REFERENCE TO RELATED APPLICATIONS

This application is a Continuation-in-Part and claims priority to U.S. patent application Ser. No. 15/787,136, filed on Oct. 18, 2017, issued Jan. 14, 2020 as U.S. Pat. No. 10,531,716, which is incorporated by reference herein in its entirety.

STATEMENT REGARDING FEDERALLY SPONSORED RESEARCH

Not applicable.

BACKGROUND

The present invention relates to a suitcase with an attached, or attachable fan, retractable cup holders, and an LED light on the fan.

The present invention is distinguished from the following art in many ways:

U.S. Pat. No. 2,224,628 to Benson is a patent concerning a standing fan. The present invention involves a fan in mechanical communication with a suitcase, which is absent in Benson.

U.S. Pat. No. 2,311,896 to Criqui discloses an axial flow fan. The present invention involves a fan in mechanical communication with a suitcase, which is absent in Criqui.

U.S. Pat. No. 2,397,169 to Troller discloses a fan with a motor structure. The present invention involves a fan in mechanical communication with a suitcase, which is absent in Troller.

U.S. Pat. No. 2,633,293 to Jones discloses an electric fan. The present invention involves a fan in mechanical communication with a suitcase, which is absent in Jones.

U.S. Pat. No. 3,802,216 to Brandimarte discloses a portable air conditioner and heating unit. The present invention involves a fan in mechanical communication with a suitcase, which is absent in Brandimarte.

U.S. Pat. No. 5,694,663 to Tserng discloses a retractable luggage handle assembly. The present invention involves a fan in mechanical communication with a suitcase, which is absent in Tserng.

U.S. Pat. No. 5,725,356 to Carter discloses a portable fan for use on a child stroller. The present invention involves a fan in mechanical communication with a suitcase, which is absent in Carter.

U.S. Pat. No. 6,386,414 to Kilduff discloses a sports bag with a fan. The present invention involves a fan in mechanical communication with a suitcase, which is absent in Kilduff. In Kilduff, the fan is made for circulating air through the gym bag. The present invention uses a fan to circulate air outside of the suitcase.

U.S. Pat. No. 6,425,255 to Hoffman discloses a suitcase cooling apparatus. The device of Hoffman is actually a portable air conditioner for use in travel to cool a bed. Hoffman is not a suitcase for storing items with a portable fan like the present invention.

U.S. Pat. No. 6,454,539 to Santos discloses a personal fan system. The present invention involves a system with a fan in mechanical communication with a suitcase, which is absent in Santos.

US 2003/0038007 to Han discloses a telescoping handle for a luggage cart. The present invention involves a fan in mechanical communication with a suitcase, which is absent in Han.

US 2012/0152677 to Lu discloses a luggage case with a power device. The present invention involves a fan in mechanical communication with a suitcase, which is absent in Lu.

US D384,144 to DuBois discloses an ornamental design for a portable fan. The present invention involves a fan in mechanical communication with a suitcase, which is absent in DuBois.

US D387150 to Coonahan discloses an ornamental design for a portable fan. The present invention involves a fan in mechanical communication with a suitcase, which is absent in Coonahan.

US D398386 to Chan discloses an ornamental design for an electric fan. The present invention involves a fan in mechanical communication with a suitcase, which is absent in Chan.

US D406331 to Chan discloses an ornamental design for an electric fan. The present invention involves a fan in mechanical communication with a suitcase, which is absent in Chan.

US D635656 to Ghosn discloses an ornamental design for an electric fan. The present invention involves a fan in mechanical communication with a suitcase, which is absent in Ghosn.

U.S. Pat. No. 8,235,686 to Wark teaches a fan with a battery, rotating blade, motor, switch, and a charge port configured for a cup holder. Wark does not have clamps that allow for the fan to be detached from the telescoping arms of the present invention.

US 2008/0283114 to Gray teaches a fan with a USB port. Gray does not have clamps that allow for the fan to be detached from the telescoping arms of the present invention.

US 2010/0051633 to Porte teaches a suitcase with a telescoping handle having a cup holder with clamps. Porte does not have clamps that allow for the fan to be detached from the telescoping arms of the present invention.

US 2006/0037825 to Dayton teaches a telescoping luggage handle with a slot. Dayton does not have clamps that allow for the fan to be detached from the telescoping arms of the present invention.

U.S. Pat. No. 5,725,356 to Carter teaches the use of hinge clamps. Carter does not have clamps that allow for the fan to be detached from the telescoping arms of the present invention.

U.S. Pat. No. 8,979,073 to Lykins teaches an insulated container. Lykins does not have clamps that allow for the fan to be detached from the telescoping arms of the present invention.

U.S. Pat. No. 8,740,070 to Page teaches a locking cooler. Page does not have clamps that allow for the fan to be detached from the telescoping arms of the present invention.

US 2016/035382 to Jose (2016/0353882) teaches a fold out tray for luggage. Jose does not have clamps that allow for the fan to be detached from the telescoping arms of the present invention.

SUMMARY

The present invention is generally a new and novel suitcase with a fan.

In several embodiments of the present invention, the present invention is a suitcase with a rechargeable, or non-rechargeable fan comprising; a suitcase with a body;

said body further comprising; a back with telescoping arm and a handle bridging said telescoping arms; a fan; said fan further comprising; a rotating blade attached to a motor and a rechargeable, or non-rechargeable fan; an On/Off switch; a charging port; a USB port; a left-side clamp and a right-side clamp; wherein said left side clamp and said right side clamp can mechanically attach between said telescoping arms. In some embodiments, an external AC/DC adaptor is used.

In several embodiments, said right-side clamp is a "c-clamp"; and said left-side clamp is a "c-clamp". In several embodiments, said right-side clamp is a hinged clamp; and said left-side clamp is a hinged clamp. In several embodiments, a back pouch is attached to said back. In several embodiments, said back pouch can envelop said fan and the lower portion of said telescoping arms. In several embodiments, a side pouch is attached to said body. In several embodiments, said side pouch can envelop, or house, said fan. In several embodiments, said fan is moveable vertically about said telescoping arms. In several embodiments, said fan is detachable from said telescoping arms. In several embodiments, said fan is rechargeable through said charging port. In several embodiments, said fan can charge a device through said USB port. In several embodiments, the fan is not rechargeable.

In several embodiments, the invention is a suitcase with a rechargeable, or non-rechargeable fan comprising; a suitcase with a body; said body further comprising; a back with telescoping arms and a handle bridging said telescoping arms; said telescoping arms further comprising a hollow interior with a slit running the length of said telescoping arms; an enclosure in said body; a fan; said fan further comprising; two rotating blades attached to a motor and a fan battery; an On/Off switch; a charging port; and a USB port; said fan is housed in said enclosure and in mechanical communication with said hollow interior of said telescoping arms, wherein once said On/Off switch is turned to on, air will be pushed via movement of said rotating blades attached to a motor into said hollow interior of said telescoping arms and out of said slit running the length of said telescoping arms. In some embodiments, said fan is rechargeable through said charging port. In some embodiments, said fan can charge a device through said USB port.

In some embodiments, the invention is a suitcase with a rechargeable, or non-rechargeable fan comprising, a suitcase with a body; said body further comprising; a back with telescoping arms and a handle bridging said telescoping arms; a fan; said fan further comprising; a rotating blade attached to a motor and a fan battery; an On/Off switch; a charging port; a USB port; and a left-side clamp and a right-side clamp; wherein said left side clamp and said right side clamp can mechanically attach between said telescoping arms, wherein said On/Off switch is turned to an on position, therein causing said motor to be activated, causing said rotating blades to push air through the fan. In some embodiments, said right-side clamp is a "c-clamp" and said left-side clamp is a "c-clamp". In some embodiments, said right-side clamp is a hinged clamp, and said left-side clamp is a hinged clamp. In some embodiments, a back pouch is attached to said back, wherein said back pouch can envelop, or house, said fan and the lower portion of said telescoping arms. In some embodiments, there is a side pouch attached to said body wherein said side pouch can envelop, or house, said fan. In, some embodiments, said fan is moveable vertically about said telescoping arms, and said fan is detachable from said telescoping aims.

In several embodiments, the present invention utilizes vents on the fan. In several embodiments, the present invention has motion sensor (on/off switch) on the fan base. In several embodiments, the present invention utilizes a pouch for battery storage on the back of the suitcase body. In several embodiments, the present invention utilizes increased strength handles to support backpacks and other slide on bags. In several embodiments, the present invention utilizes a variable speed fan able to move 100-140 CFM at maximum speed. In several embodiments, there is a control on the fan with an "On/Off" capability and/or a variable speed setting. In several embodiments, the present invention contains an external AC/DC adapter in plug head (48" long—2 prong) UL Listed—built into storage area in bag with poka-yoke methodology to prevent omission when re-packing. In several embodiments, the present invention uses a protective fan blade cover or non-personal injury damaging blade design. In several embodiments, the present invention uses a motion activated LED night light rated at adequate lumens to illuminate a walk/hotel area.

In several embodiments, the present invention utilizes a control requirement—always on when unit is plugged in, along with an LED light that helps to guide user to light on/off switch. In several embodiments the fan unit must be retractable allowing clear use of handle without exposing fan unit. In several embodiments, the fan/light unit will recess/slide mount into protective case/area for optional use when ready. In several embodiments of the present invention, the fan unit should be easily detachable from suitcase body to be used independently. In several embodiments, the fan unit should pivot in handle. In several embodiments, the present invention will utilize an inflatable bladder to keep less than full, loads in place.

In some embodiments, the present invention is a suitcase with a fan comprising; a suitcase with a body; said body further comprising; a back with a back pouch with a pouch housing and telescoping arms capable of retracting in and out of the body of the suitcase with a handle bridging said telescoping arms; and a retractable cup holder; a fan; said fan further comprising; at least one rotating blade attached to a motor and a battery; an On/Off switch; a charging port; a USB port; a motion activated LED light; and a detachable left-side pivot assembly and a detachable right-side pivot assembly; wherein said detachable left-side pivot assembly and a detachable right-side pivot assembly can mechanically attach said fan between said telescoping arms; wherein said detachable left-side pivot assembly and a detachable right-side pivot assembly permit removal of said fan from said telescoping arms. In some embodiments, the suitcase with a fan further comprises a pouch for storage on the back of said suitcase body. In some embodiments, said fan further comprises; a protective fan blade cover or non-personal injury damaging blade design. In some embodiments, the suitcase with a fan further comprises said back, which further comprises a back pouch attached to said back. In some embodiments, the suitcase with a fan further comprises said back pouch can envelop said fan and the lower portion of said telescoping arms. In some embodiments, the suitcase with a fan further comprises a side pouch attached to said body for containing anti-bacterial wipes. In some embodiments, the suitcase with a fan further comprises said battery, further comprises an external AC/DC adapter. In some embodiments, the suitcase with a fan further comprises said fan is moveable vertically about said telescoping arms. In some embodiments, the suitcase with a fan further comprises said fan is detachable from said telescoping arms. In some embodiments, the suitcase with a fan further comprises said body further comprises a bag expansion control. In some embodiments, the suitcase with a fan further comprises said fan can charge an electronic device through said USB port.

In some embodiments of the present invention, a suitcase with a rechargeable fan comprising; a suitcase with a body; said body further comprising; a back with telescoping arms and a handle bridging said telescoping arms; said telescoping arms further comprising a hollow interior with slits running the length of said telescoping arms; a grill vent for intake of air; an enclosure in said body; a fan; said fan further comprising; a rotating blade unit attached to a motor and a rechargeable battery; an On/Off switch; a charging port; and a USB port; said fan is housed in said enclosure and in mechanical communication with said hollow interior of said telescoping arms, wherein once said On/Off switch is turned to on, air will be taken in through said grill into said hollow interior and pushed via movement of said rotating blades attached to a motor into said hollow interior of said telescoping arms, and out of said slits running the length of said telescoping arms. In several embodiments, the suitcase with a rechargeable fan further comprises, said fan is rechargeable through said charging port. In several embodiments, said fan can charge a device through said USB port.

BRIEF DESCRIPTION OF THE DRAWINGS

For a more complete understanding of the present disclosure and the advantages thereof, reference is now made to the following descriptions to be taken in conjunction with the accompanying drawings describing specific embodiments of the disclosure, wherein.

DETAILED DESCRIPTION

Figure 1:
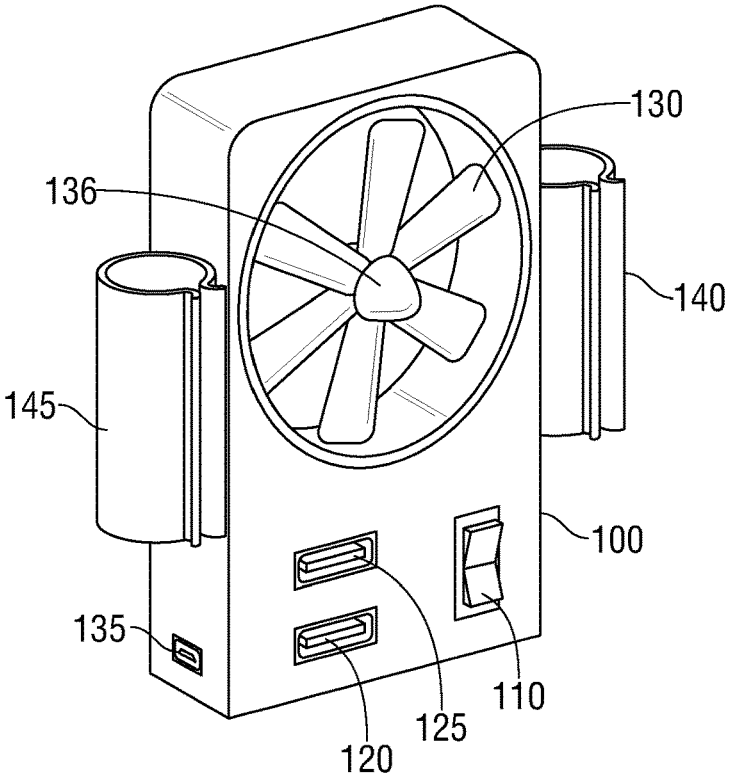
FIG. 1 is partial side view of one embodiment of the fan of the present invention.

One or more illustrative embodiments incorporating the invention disclosed herein are presented below. Applicant has created a revolutionary and novel suitcase with a fan and method of use of the same.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless, or essentially meaningless, the definition should be taken from Webster's Dictionary 2016. Definitions and/or interpretations should not be incorporated from other patent applications, patents, or publications, related or not, unless specifically stated in this specification, or if the incorporation is necessary for maintaining validity. Specifically, defined terms: "Suitcase" as defined herein can include any suitcase, computer bag, garment bag, or object used to store items when traveling that has telescoping handles. "Fan" as defined herein, includes any device capable of moving air by changing the velocity of air flow. "On/Off Switch" as defined herein is any switch capable of regulating, initiating, or terminating a current or electrical circuit.

Certain terms are used in the following description and claims to refer to particular system components. As one skilled in the art will appreciate, different persons may refer to a component by different names. This document does not intend to distinguish between components that differ in name but not function. The drawing figures are not necessarily to scale. Certain features of the invention may be shown exaggerated in scale or in somewhat schematic form, and some details of conventional elements may not be shown, all in the interest of clarity and conciseness.

Although several preferred embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the scope of the invention is not to be limited thereby.

Figure 8:
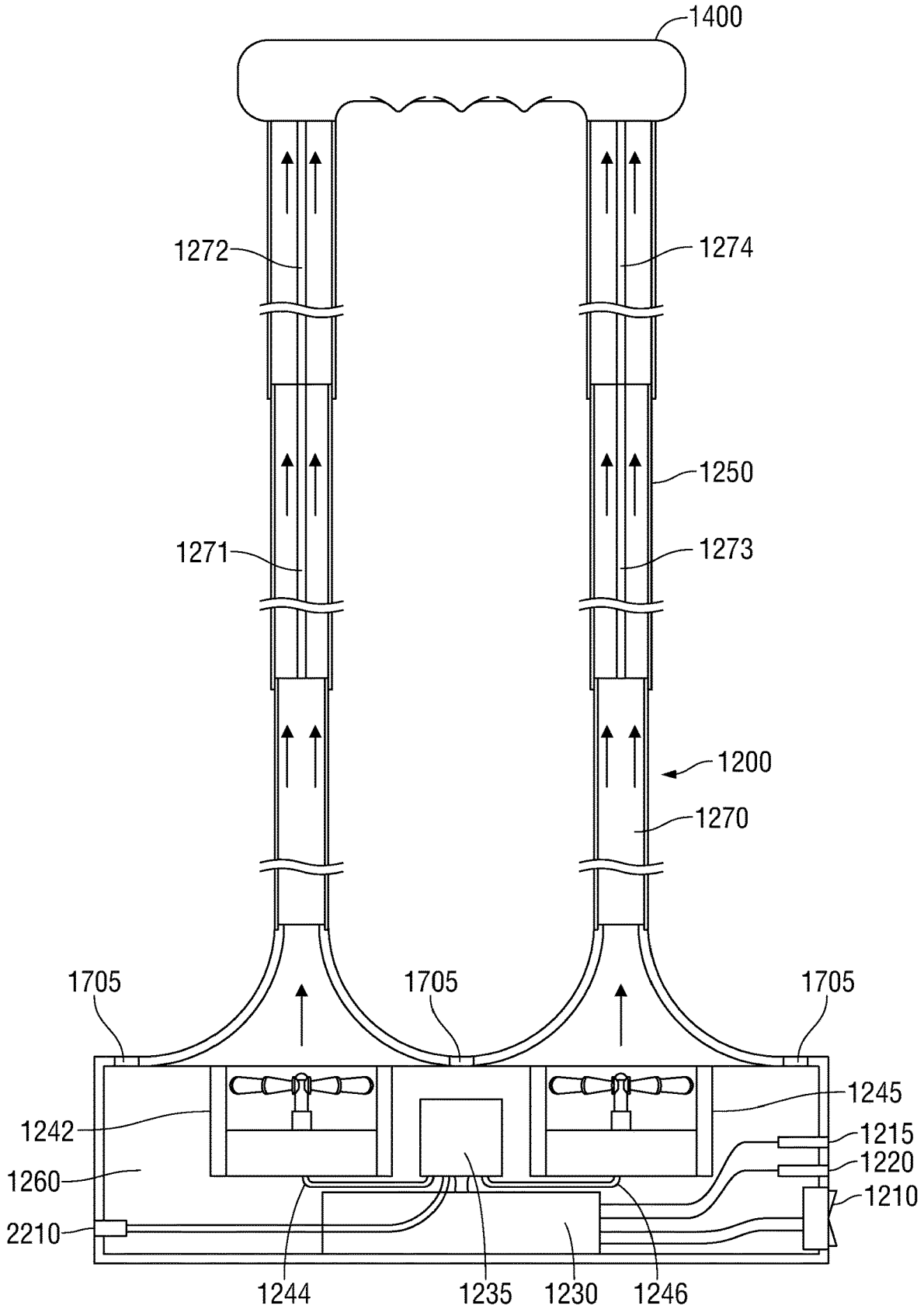
FIG. 8 is a partial cut away view of the fan hollow arms apparatus of one embodiment of the present invention.
Figure 9:
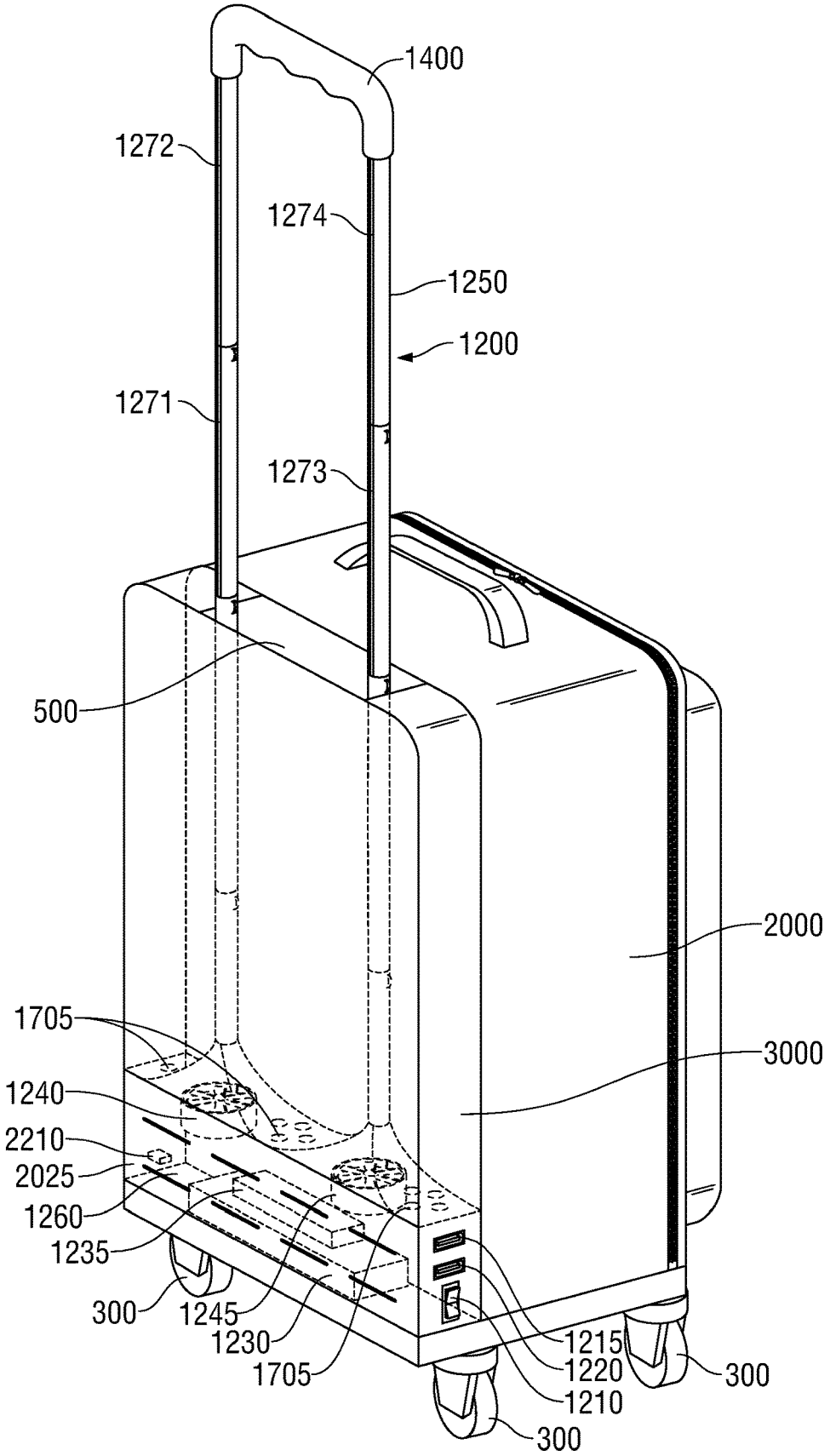
FIG. 9 is a partial side view of one embodiment of the present invention in which the fan hollow arms apparatus is encapsulated in a suitcase.

FIG. 1 is partial side view of one embodiment of the fan of the present invention. As shown in several embodiments, the fan 100 is constructed to be of portable size and preferably with an exterior comprised of plastic or other sturdy but lightweight material. As shown, fan 100 utilizes six blades 130, as are known in the art, but it is envisioned that a plurality of blades ranging from two to ten could be utilized. Blades 130 are preferably positioned in fan 100 as is known in the art for fans, as illustrated blades 130 are positioned about rotation axle 136 as is known in the art. Fan 100 is preferably battery operated and rechargeable as is known in the art. Fan 100 may be constructed with internal circuitry and connectivity as is known in the art for use with a rechargeable, or non-rechargeable portable fan. At the very least (as shown in FIGS. 8-9) fan 100 will include a motor and fan battery as is engaged to allow for rotation of blades 130 when fan 100 is actuated. In several embodiments, fan 100 utilizes a non-rechargeable battery.

Further illustrated in FIG. 1 is the "On/Off" switch 110 as is known in the art for fans. It is envisioned that On/Off switch 110 is wired with fan 100 in standard wiring format for a fan. In many embodiments of the present invention, fan 100 is activated by flipping the On/Off switch 110 in the "on" position, therein allowing a current to flow through the fan's circuitry in the manner normally known in the art and energizing the fan motor to, run, therein rotating the fan blades 130. In several embodiments, the On/Off switch 110 can be in electrical communication with the motor so as to regulate rotation speed of said blades 130, as known in the art.

Located near the On/Off Switch 110 are USB ports 120 and 125. USB ports 120 and 125 are preferably designed to interact with standard USB cable attachments and allow for fan 100 to, charge electrically engaged items when fan 100 is charged or charging. Further shown in FIG. 1 is recharge port 135. Recharge port 135 is preferably designed to allow for fan 100 to be plugged into a standard wall outlet in order to be recharged. In several embodiments, USB ports 120 and 125 are designed to be able to charge a phone, or tablet electronic device as is known in the industry.

Figure 2:
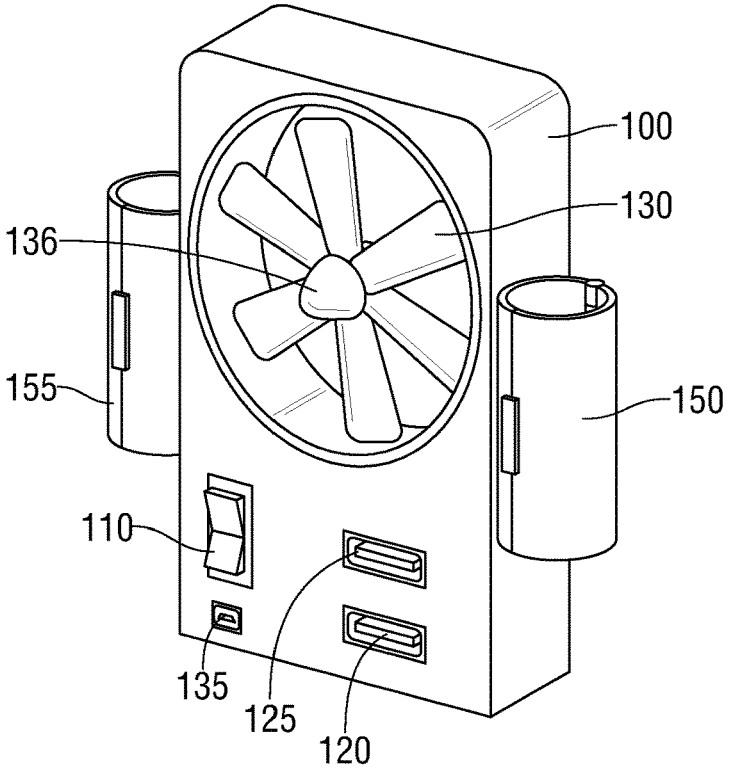
FIG. 2 is partial side view of another embodiment of the fan of the present invention.

FIG. 1 and FIG. 2 illustrate different placements of articles on the surface of fan 100. As shown, are variant forms of arm clamps 140, 145, 150 and 155 respectively, although different arm clamp arrangements could be used by one of ordinary skill in the art. Variant clamp arrangements could be, but are not limited to, c-clamps, snap clamps, vise clamps, or other clamps capable of holding an object to a pipe, or other three-dimensional piece.

As shown, arm clamps 140 and 145 are closed partial "C" snap clamps (referenced herein as the "C-clamp") that can be opened, as known in the art by pushing a bar or other solid object through the lips of clamps 140 or 145. The molded spring action of clamps 140 or 145 will then hold the object in place. Arm clamps 150 and 155 are snapping hinge clamps that are designed to snap together in the front as rotating about a hinge in order to hold an object in place.

As shown in FIGS. 1 and 2, USB ports 120 and 125, charge port 135 and On/Off Switch 110 can be in various positions on fan 100. In several embodiments, a separate control panel for the functions of the fan 100 can be found in the body of the suitcase 1000 (See FIG. 3 for suitcase 1000). As shown in FIG. 1, charge port 135 is substantially on the side of fan 100, as opposed to in FIG. 2, in which charge port 135 is located on the front face of fan 100. FIG. 1 and FIG. 2 also have the On/Off switch 110 and USB ports 120 and 125 on opposite sides of the front face of fan 100. One of ordinary skill in the art could combine the various USB ports 120 and 125 and the "On/Off" switch 110 in numerous location permutations on fan 100.

Figure 3:
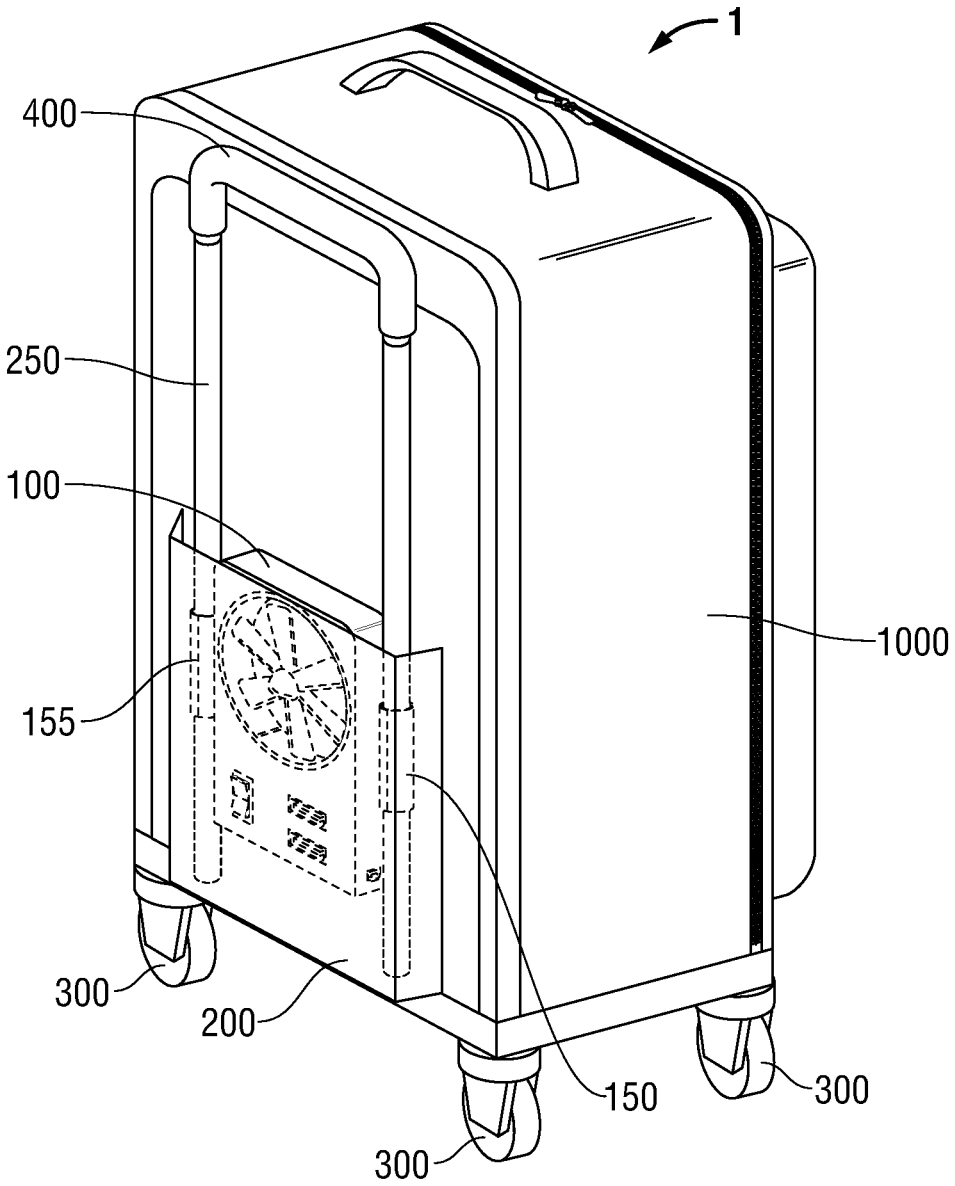
FIG. 3 is a partial side view of one embodiment of the present invention with the fan stored in a back pouch of one embodiment of the suitcase of the present invention.

FIG. 3 is a partial side view of one embodiment of the present invention with the fan stored in a back pouch of one embodiment of the suitcase of the present invention. As shown, suitcase 1000 is a trundler with standard coasting wheels 300. It is envisioned that the present invention need not be a trundler but may be in any form of a suitcase as is used in the art of suitcases.

As illustrated, in some embodiments, fan 100 can be stored in exterior rear pouch 200 preferably located on the back of suitcase 1000. Exterior rear pouch 200 is preferably constructed to be able to fully envelop fan 100, as well as the lower portion of telescoping arms 250. Exterior rear pouch 200 is preferably constructed of a strong but pliable material, with structural frame members of construction for support and durability.

As shown, telescoping arms 250 are preferably designed as used in the art for extension and then movement of a wheeled suitcase 1000. Telescoping arms 250 are preferably mechanically attached to fan 100 via clamps 150 and 155. Clamps 150 and 155 can be of the variety of clamps utilized to moveably attach to telescoping arms 250. Further illustrated, is luggage handle 400 which joins telescoping arms 250 and makes a substantially U-shaped handle by which a user can move the suitcase. Luggage handle 400 is preferably a luggage handle as is known in the art.

Figure 4:
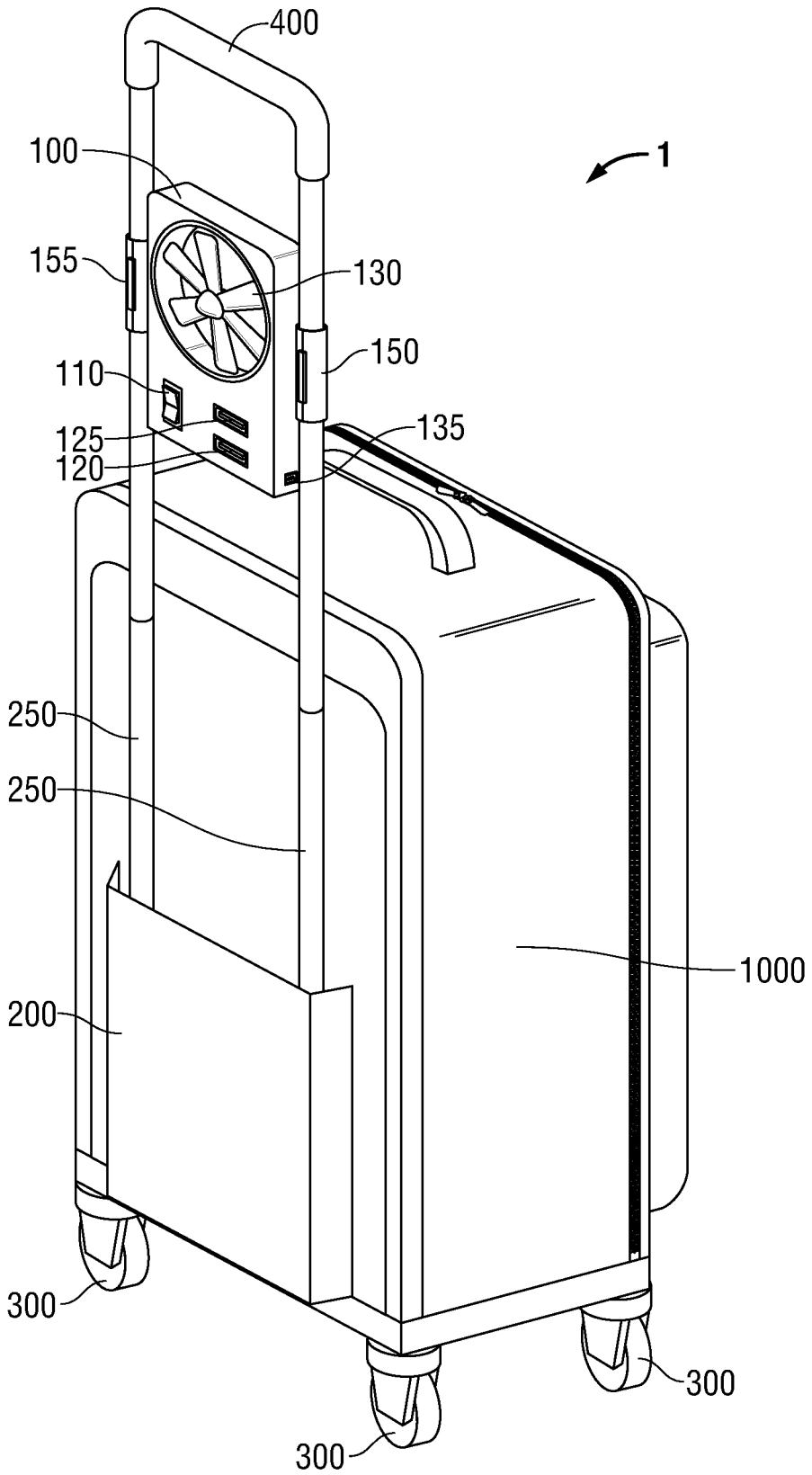
FIG. 4 is a partial side view of one embodiment of the present invention with the fan out of a back pouch of one embodiment of the suitcase of the present invention.

FIG. 4 is a partial side view of one embodiment of the present invention with the fan out of the back pouch of one embodiment of the suitcase of the present invention. As shown, suitcase 1000 is a trundler with standard coasting wheels 300. It is envisioned the present invention need not be a trundler but may be in any form of a suitcase as is used in the art of suitcases. As illustrated, in some embodiments, fan 100 is extricated from the exterior rear pouch 200, preferably located on the back of suitcase 1000. Exterior rear pouch 200 is preferably constructed to be able to fully envelop fan 100, as well as the lower portion of telescoping arms 250. Telescoping arms 250 are preferably designed as used in the art for extension and then movement of a wheeled suitcase 1000. Telescoping arms 250 are preferably mechanically attached to fan 100 via clamps 150 and 155. Clamps 150 and 155 can be of the variety of clamps utilized to moveably attach to telescoping arms 250. Further illustrated, is luggage handle 400 which joins telescoping arms 250 and makes a substantially U-shaped handle by which a user can move the suitcase.

Fan 100 from either FIG. 1 or FIG. 2 can be used in the embodiment shown. FIG. 1 and FIG. 2 illustrate variant forms of arm clamps 140, 145, 150 and 155 respectively, although different arm clamp arrangements could be used by one of ordinary skill in the art. As shown, arm clamps 140 and 145 are closed partial "C" clamps that can be opened, as known in the art by pushing a bar, or other solid object through the lips of the clamp 140 or 145. The molded spring action of the clamp 140 or 145 will then hold the object in place. As shown, it is the strength of the mold itself that keeps the arm clamps securely fastened to telescoping arms 250 when in use. Arm clamps 150 and 155 are snapping clamps that are designed to snap together in the front in order to hold an object in place. As shown in FIGS. 1 and 2, USB ports 120 and 125, charge port 135 and On/Off Switch 110 can be in various location positions on fan 100.

In several embodiments of the present invention, while in operation, fan 100 is extricated from exterior rear pouch 200 and attached to telescoping arms 250, which are also telescoped out of exterior rear pouch 200. In operation, in some embodiments of the present invention, On/Off switch 110 is activated, therein rotating the blades 130 in a manner known in the art for portable fans. During operation of the fan blades 130, or even when the On/Off switch 110 is not activated, fan 100 can charge electrical devices from USB ports 120 and 125. Charge port 135 is also visible and can be used to charge fan 100 while either fan 100 is in operation or when it is not activated. A user in many circumstances can rotate suitcase 1000 about wheels 300 in order to have air blown from fan 100 in a direction desired by the user.

Figure 5:
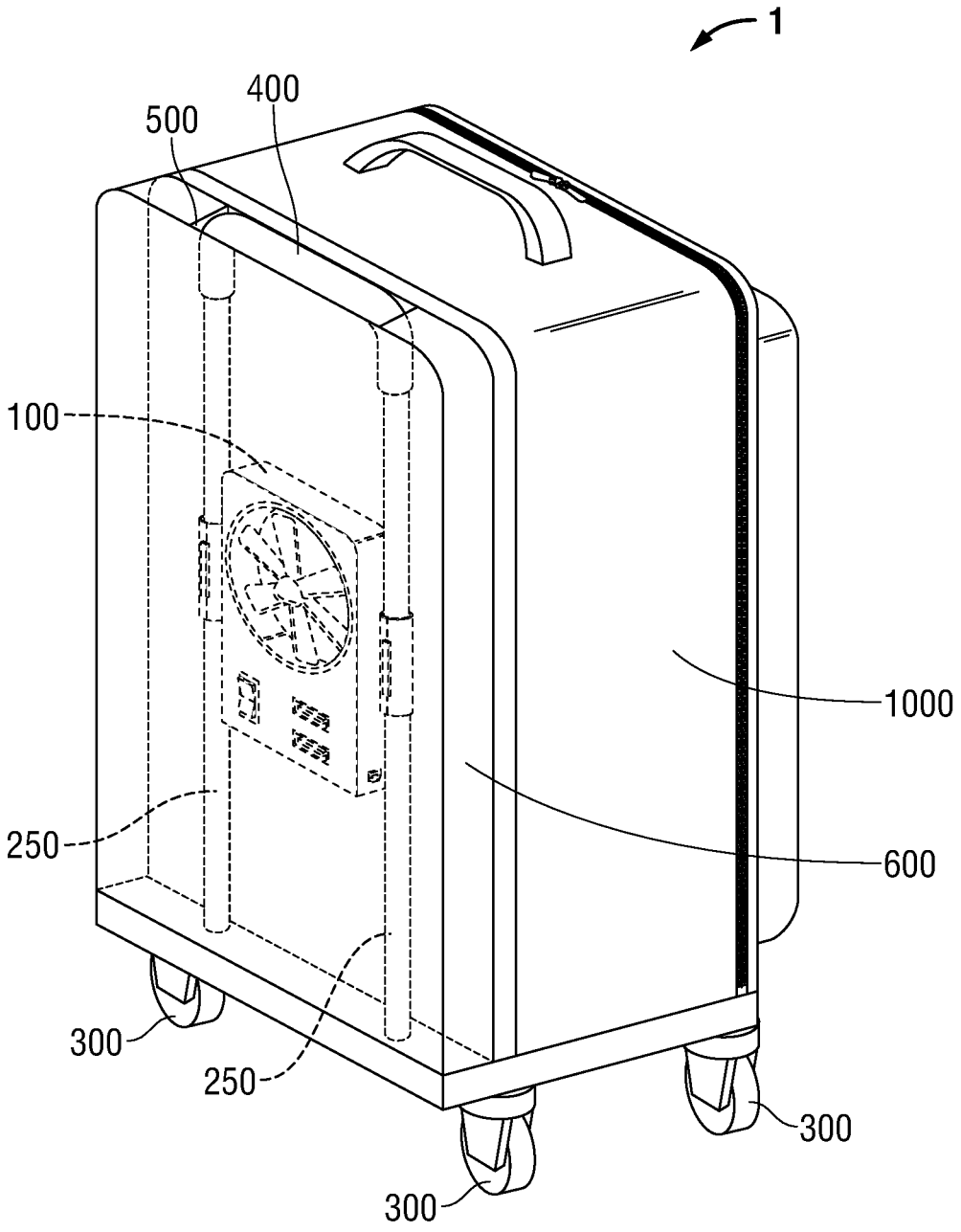
FIG. 5 is a partial side view of one embodiment of the present invention in which the telescoping arms are encapsulated in the body of the suitcase, and the fan is attached to the telescoping arms.

FIG. 5 is a partial side view of one embodiment of the present invention in which the telescoping arms 250 are encapsulated in the body of the suitcase and the fan 100 is attached to the telescoping arms 250. As shown in FIG. 5, is some embodiments of the present invention, telescoping arms 250 are fully encapsulated at the back of a suitcase 1000. The encapsulating area 600 is preferably large enough in volume to encapsulate fan 100 as well. As shown, luggage handle 400 extends from (and substantially encompasses) orifice 500.

Figure 6:
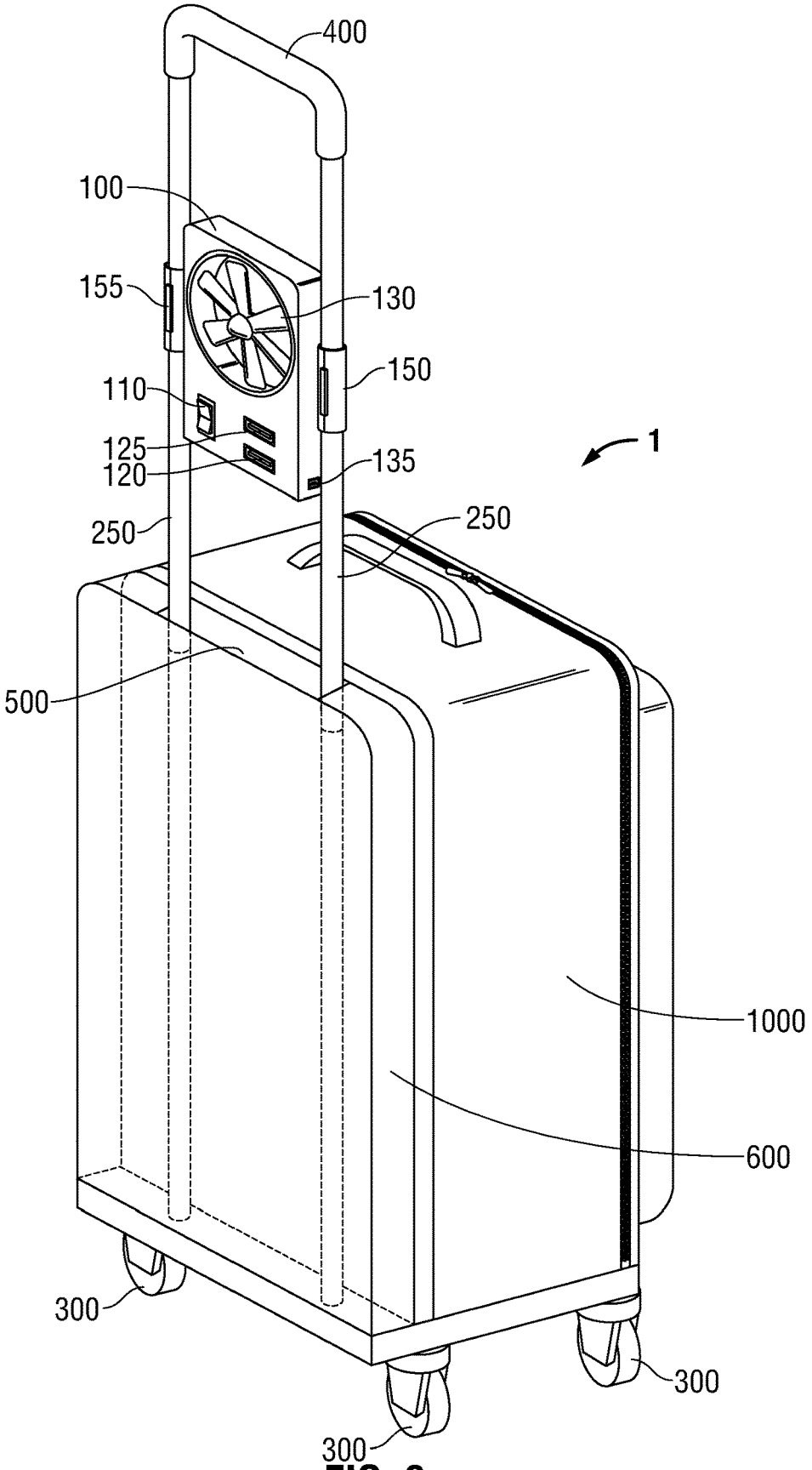
FIG. 6 is a partial side view of one embodiment of the present invention in which the telescoping arms are extended from the body of the suitcase, and the fan is attached to the telescoping arms.

FIG. 6 is a partial side view of one embodiment of the present invention in which the telescoping arms 250 are encapsulated in the body of the suitcase 1000 and the fan 100 is attached to the telescoping arms 250. As shown in FIG. 5, in some embodiments of the present invention, telescoping arms 250 can be extended from the back of a suitcase 1000. The encapsulating area 600 is preferably large enough in volume to encapsulate fan 100 as well. As shown, luggage handle 400 extends from (and substantially encompasses) orifice 500. As shown, telescoping arms 250 are extended out of orifice 500 and fan 100 is no longer encapsulated in encapsulating area 600 and is ready for use.

In several embodiments of the present invention, while in operation, fan 100 is extricated from exterior rear pouch 200 (See FIG. 4) and attached to telescoping arms 250 which are also telescoped out of encapsulating area 600. In operation, in some embodiments of the present invention, On/Off switch 110 is activated, therein rotating the blades 130 in a manner known in the art for portable fans. During operation of the fan blades 130, or even when the On/Off switch 110 is not activated, a user can charge an electrical device from USB ports 120 and 125. Charge port 135 is also visible and can be used to charge fan 100 while either fan 100 is in operation or when it is not activated. A user in many circumstances can rotate suitcase 1000 about wheels 300 in order to have air blown from fan 100 in a direction desired by the user.

Figure 7:
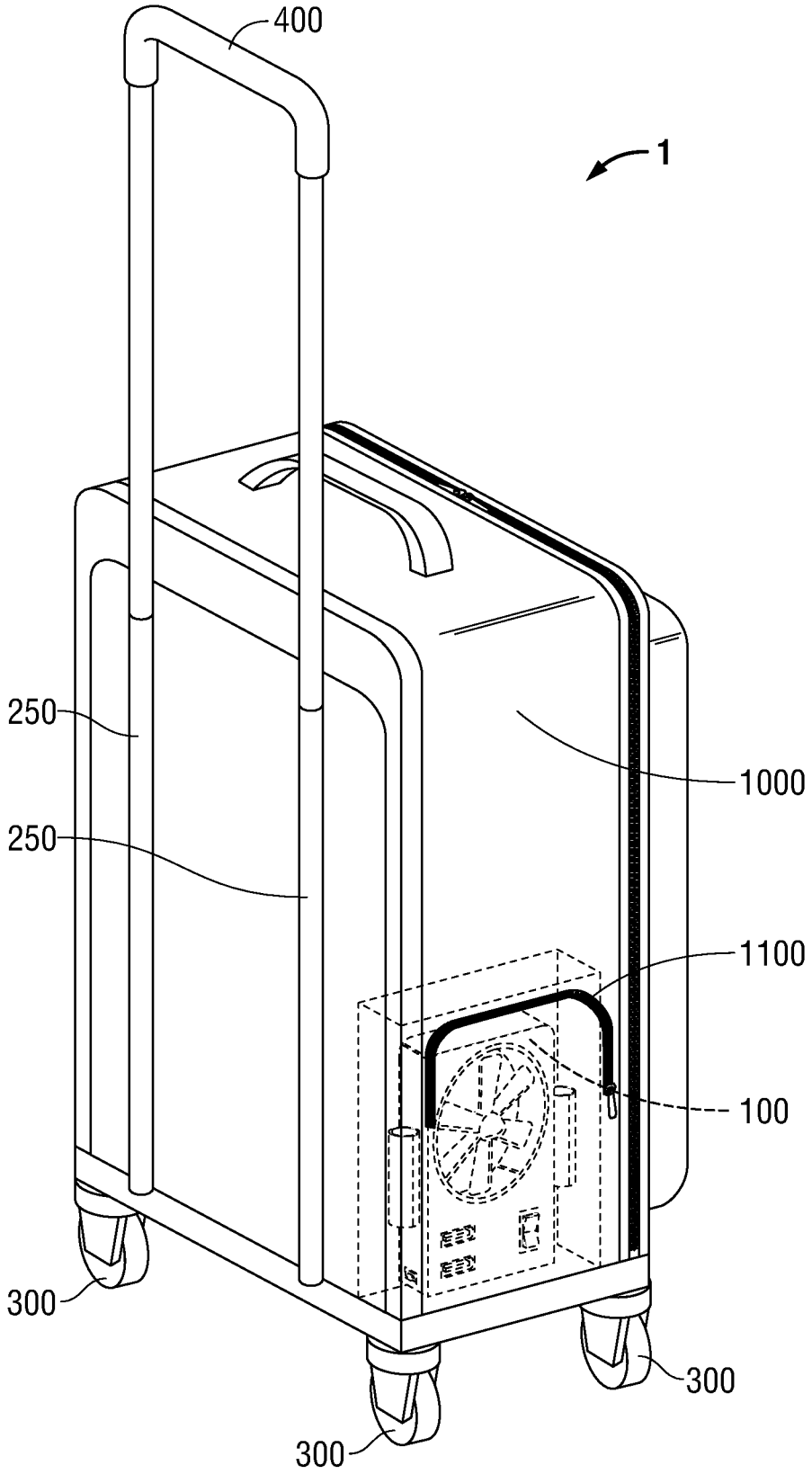
FIG. 7 is a partial side view of one embodiment of the present invention in which the fan is stored in an encapsulated side pocket of the suitcase.

FIG. 7 is a partial side view of one embodiment of the present invention with the fan 100 stored in a side pouch 1100 of one embodiment of the suitcase 1000 of the present invention. As shown, suitcase 1000 is a trundler with standard coasting wheels 300. It is envisioned the present invention need not be a trundler but may be in any form of a suitcase as is used in the art of suitcases. As illustrated, in some embodiments, fan 100 can be stored in a side pouch 1100, preferably located on the side of suitcase 1000. Side pouch 1100 is preferably constructed to be able to fully envelop, or house, fan 100. Telescoping arms 250 are preferably designed as used in the art for extension and then movement of a wheeled suitcase 1000. Telescoping arms 250 are preferably mechanically attached to fan 100 via clamps 150 and 155 during operation (See FIG. 4). Clamps 150 and 155 can be of the variety of clamps utilized to moveably attach to telescoping arms 250. Further illustrated, is luggage handle 400 which joins telescoping arms 250 and makes a substantially U-shaped handle by which a user can move the suitcase 1000.

In several embodiments, a user can take fan 100 out of side pouch 1100 and attach fan 100 to telescoping arms 250 with clamps 150 and 155. In operation, in some embodiments of the present invention, On/Off switch 110 is activated, therein rotating the blades 130 in a manner known in the art for portable fans. During operation of the fan blades 130, or even when the On/Off switch 110 is not activated, a user can charge an electrical device from USB ports 120 and 125. Charge port 135 is also visible and can be used to charge fan 100 while either fan 100 is in operation or when it is not activated. A user in many circumstances can rotate suitcase 1000 about wheels 300 in order to have air blown from fan 100 in a direction desired by the user.

FIG. 8 is a partial cut away view of the fan hollow arms apparatus of one embodiment of the present invention. As shown, "bladeless" fan apparatus 1200 has several components. Lower housing portion 1260 is preferably designed to fit into the body of a suitcase (See FIG. 10) and to house several components that are utilized for air circulation. As shown, control regulator 1230 is in electronic communication with power source 1235. Attached to power source 1235 in electronic communication are fans 1242 and 1245. Also illustrated, are vent ports 1705 designed to allow air to enter into lower housing portion 1260 for circulation by fans 1242 and 1245. Also shown in FIG. 8, is charge port 2210 which is capable of relaying a charge to power source 1235 as is known in the art for a fan battery.

As shown, housing portion 1260 is illustrated with an external On/Off control switch 1210 attached to control regulator 1230. Further attached to control regulator 1230 are external USB ports 1215 and 1220. USB ports 1215 and 1220 are of the variety as are known in the art. As illustrated in FIG. 8, telescoping arms 1250 are preferably constructed with a hollow interior 1270, as well as air egress slits 1271-1274, which may run substantially the length of the telescoping arms 1250 and are substantially defined as opening(s) between the hollow interior 1270 and the solid exterior of telescoping arms 1250. As shown, air egress slits 1271-1274 are designed in some embodiments to only be present on the portions of telescoping arms 1250 that extend past the top of suitcase 2000 during operation (FIG. 9).

In operation, in some embodiments, when On/Off switch 1210 is turned on, a signal is sent to control regulator 1230 and power is supplied from battery 1235 to fan 1242 via circuit 1244, as well as power being supplied to fan 1245 via circuit 1246. Fans 1242 and 1245 will then activate and push air drawn from vent ports 1705 into hollow interior 1270. Said air will then exit through air egress slits 1271-1274.

FIG. 9 is a partial side view of one embodiment of the present invention in which the fan hollow apparatus is encapsulated in a suitcase 2000. As shown, lower housing portion 1260 is preferably designed to fit into the body of a suitcase 2000 (See FIG. 10) and to house several components that are utilized for air circulation. As shown, control regulator 1230 is in electronic communication with power source 1235. Attached to power source 1235 in electronic communication are fans 1242 and 1245. Also illustrated are vent ports 1705 designed to allow air to enter into lower housing portion 1260 for circulation by fans 1242 and 1245. As illustrated, lower housing portion 1260 is substantially housed in the lower portion of suitcase back housing 3000. Suitcase back housing 3000 is preferably constructed to be on the back of a suitcase 2000 and to have orifice 500, which also houses telescoping arms 1250.

In operation, in some embodiments, when On/Off switch 1210 is turned on, a signal is sent to control regulator 1230 and power is supplied from battery 1235 to fan 1242 via circuit 1244, as well as power being supplied to fan 1245 via circuit 1246 (See FIG. 8). Fans 1242 and 1245 will then activate and push air drawn from vent ports 1705 into hollow interior 1270. Said air will then exit through air egress slits 1271-1274. Further shown on FIG. 9 is air intake grill 2025 to draw in air to the hollow interior 1270 from outside of the fan apparatus 1200.

Figure 10:
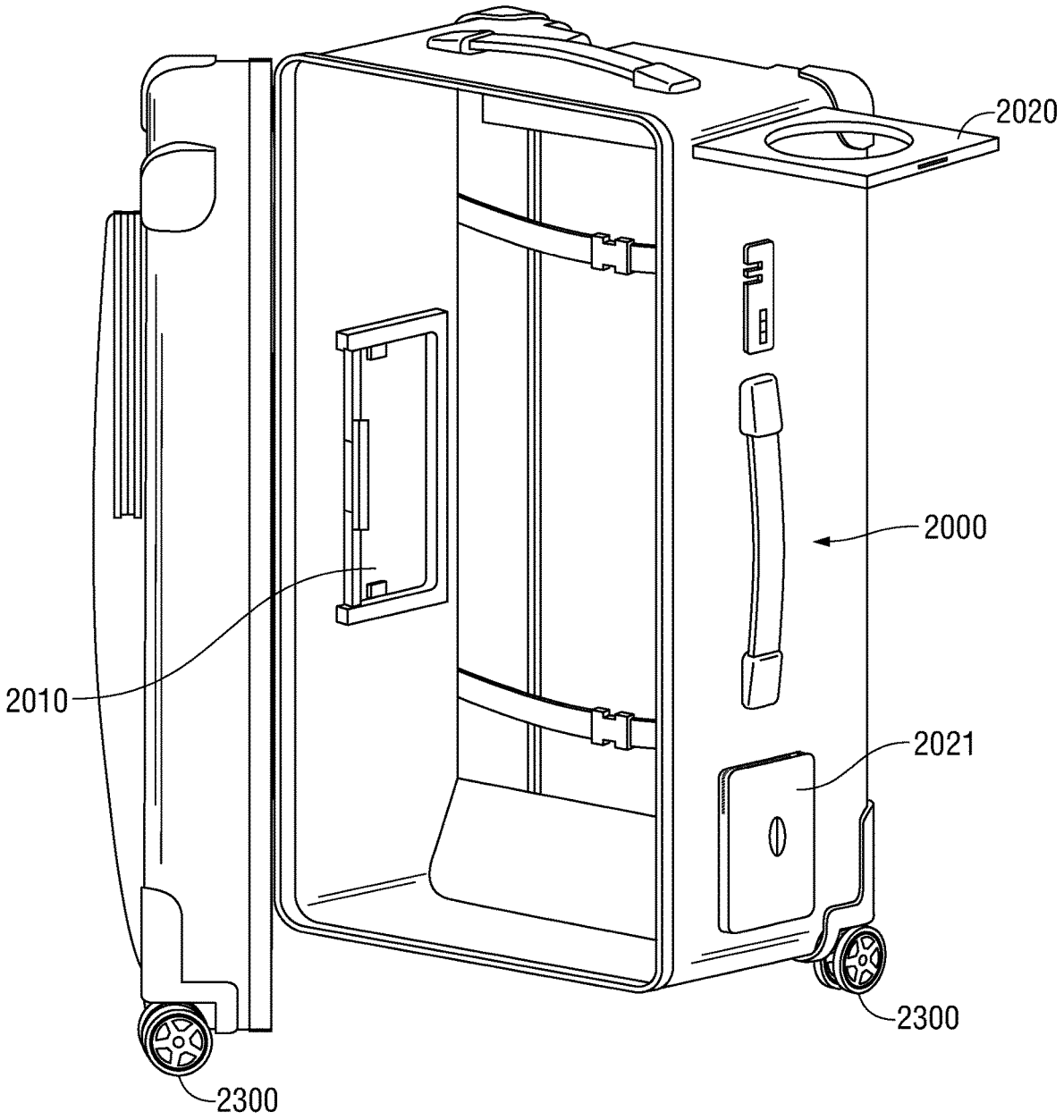
FIG. 10 is a partial side view of one embodiment of the present invention in which the suitcase is in an open position.

FIG. 10 is a partial side view of one embodiment of the present invention in which the suitcase 2000 is in an open position. As shown, in opened position, suitcase, or luggage 2000 has wheels 2300 at its base upon which it can rotate. Further illustrated is bag expansion control 2010 which operates to expand in the interior of the suitcase 2000 to secure internal items when the suitcase 2000 is in operation. Further illustrated is retractable cup holder 2020, which can retract or extend from a housing in the upper portion of suitcase, or luggage 2000. In several embodiments of the present invention, cup holder 2020 can be of variant size to hold a beverage. In several embodiments, as illustrated, is the anti-bacterial wipes compartment 2021. As illustrated, the anti-bacterial wipes compartment 2021 functions to hold anti-bacterial wipes.

In several embodiments, cup holder 2020 is designed to attach internally into the upper part of the luggage 2000. In several embodiments, cup holder 2020 has an external spring-loaded push button to react by touch and project outside of the luggage 2000. In several embodiments, cup holder 2020 is designed to hold drinks of sizes ranging from 6 oz. to 24 oz. In several embodiments, cup holder 2020 has a movable under support so it is very compact when put away. In several embodiments, only slight force need be exerted to push back cup holder 2020 into luggage 2000. In several embodiments, some materials used for construction of cup holder 2020 are aluminum, polycarbonate blend for impact resistance. Other materials can be used depending on the prior art. Color selection can vary and depend on materials of manufacturing.

In several embodiments, the present invention includes the anti-bacterial wipe packaging compartment storage 2021. There is a zipper at one end of the compartment for access. The size of the compartment is 3.5" width×7" long. The size of the compartment is based on the packaging of disposable anti-bacterial wipes presently on the market today. The size of the packaging may vary, so the compartment may be larger or smaller for practical use. The zipper shall open one end of the compartment, and a package of disposable anti-bacterial wipes placed inside for use as needed. A small capped access hole in the center of the compartment is provided to facilitate the removal of a wipe. The cap can be placed back to keep the wipes fresh.

Figure 11:
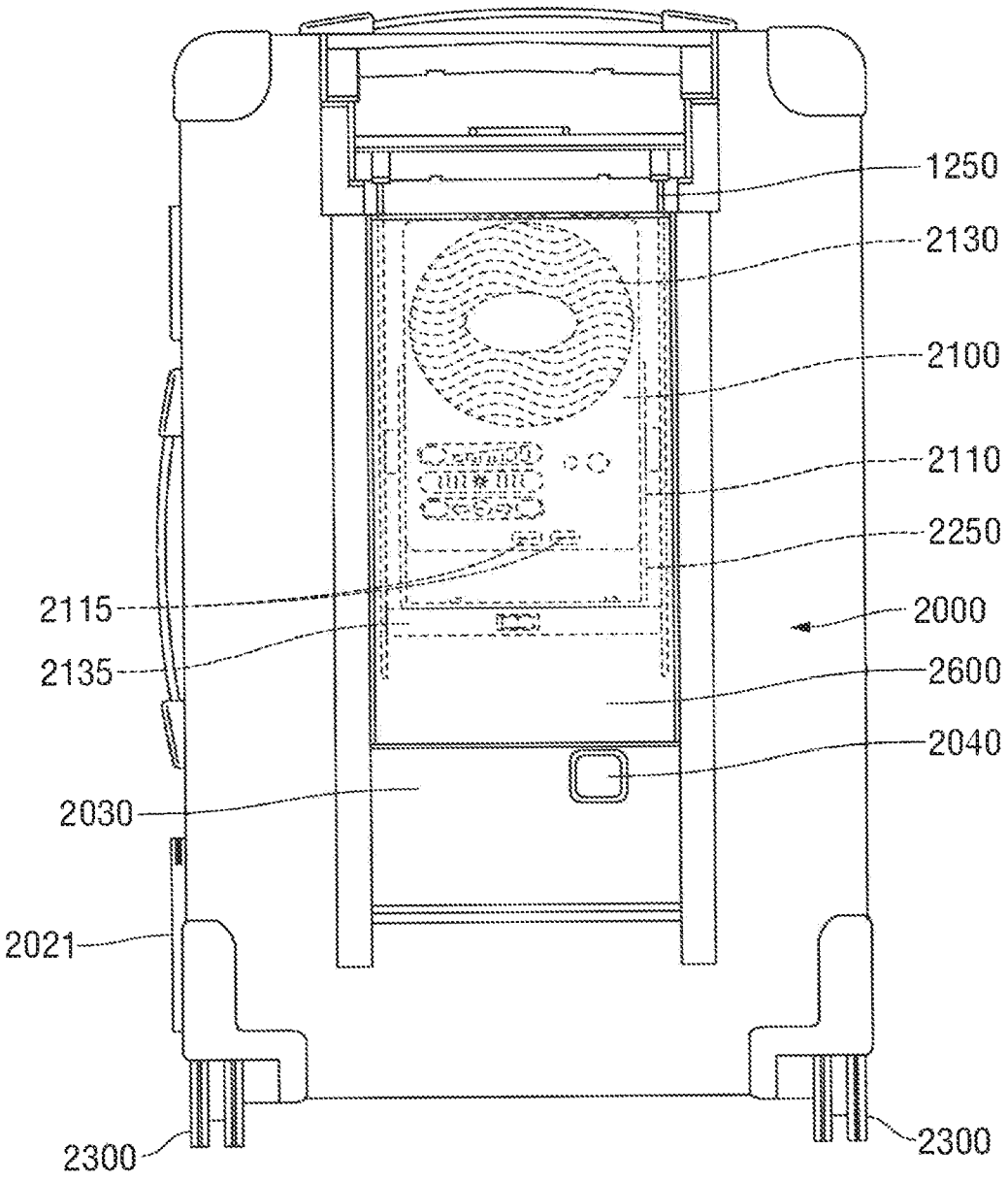
FIG. 11 is a partial cut away back view of one embodiment of the present invention in which the fan hollow arms apparatus is encapsulated in a suitcase.

FIG. 11 is a partial cut away back view of one embodiment of the present invention in which the fan hollow arms apparatus is encapsulated in a suitcase 2000. As shown in FIG. 11, in some embodiments of the present invention, telescoping arms 2250, and 1250 (See FIG. 12) are fully encapsulated at the back of a suitcase 2000. The encapsulating area 2600 is preferably large enough in volume to encapsulate fan 2100 as well.

In several embodiments, the present invention has a housing attachment 2125, on the fan base. In several embodiments, the present invention utilizes a pouch/door 2030 for battery storage and a/c cord storage on the back of the suitcase body 2000. In several embodiments, the present invention utilizes increased strength handles 1250 to support backpacks and other slide-on bags (See FIG. 12). In several embodiments, the present invention utilizes a variable speed fan 2100 able to move 100-140 CFM at maximum speed. In several embodiments, the fan 2100 has a mesh cover 2130.

In several embodiments, there is a touch control on/off and fan speed control 2120 on the fan 2100 with an "On/Off" capability and/or a variable speed setting. In several embodiments, the present invention contains an external AC/DC adapter in plug head (48" long—2 prong) UL Listed—built into the storage area in bag with poka-yoke methodology to prevent omission when re-packing. In several embodiments, the present invention uses a protective fan blade cover or non-personal injury damaging blade design 2130. In several embodiments, the fan 2100 uses a motion activated LED night light 2127 rated at adequate lumens to illuminate a walk/hotel area. In several embodiments, the LED night light 2127 has a small uniform emitting surface which enables both directional and non-directional lighting. It is a neutral white 4000k, 425 lumens. It is controlled by capacitive slider. The control is operated by touch. The user can slide his/her finger across the controller for LED brightness/dimness and also LED timer control 2122.

In several embodiments, the present invention utilizes a control requirement—always on when unit is plugged in, along with an LED that helps to guide user to light on/off switch 2121. In several embodiments, the fan unit 2100 must be retractable allowing clear use of handle 1400 without exposing fan unit 2100. In several embodiments, the fan/light unit 2100 will recess/slide mount into protective case/area for optional use when ready. In several embodiments of the present invention, the fan unit 2100 should be easily detachable from suitcase body 2000 to be used independently. In several embodiments, the fan unit 2100 should pivot in handle 1400.

Figure 12:
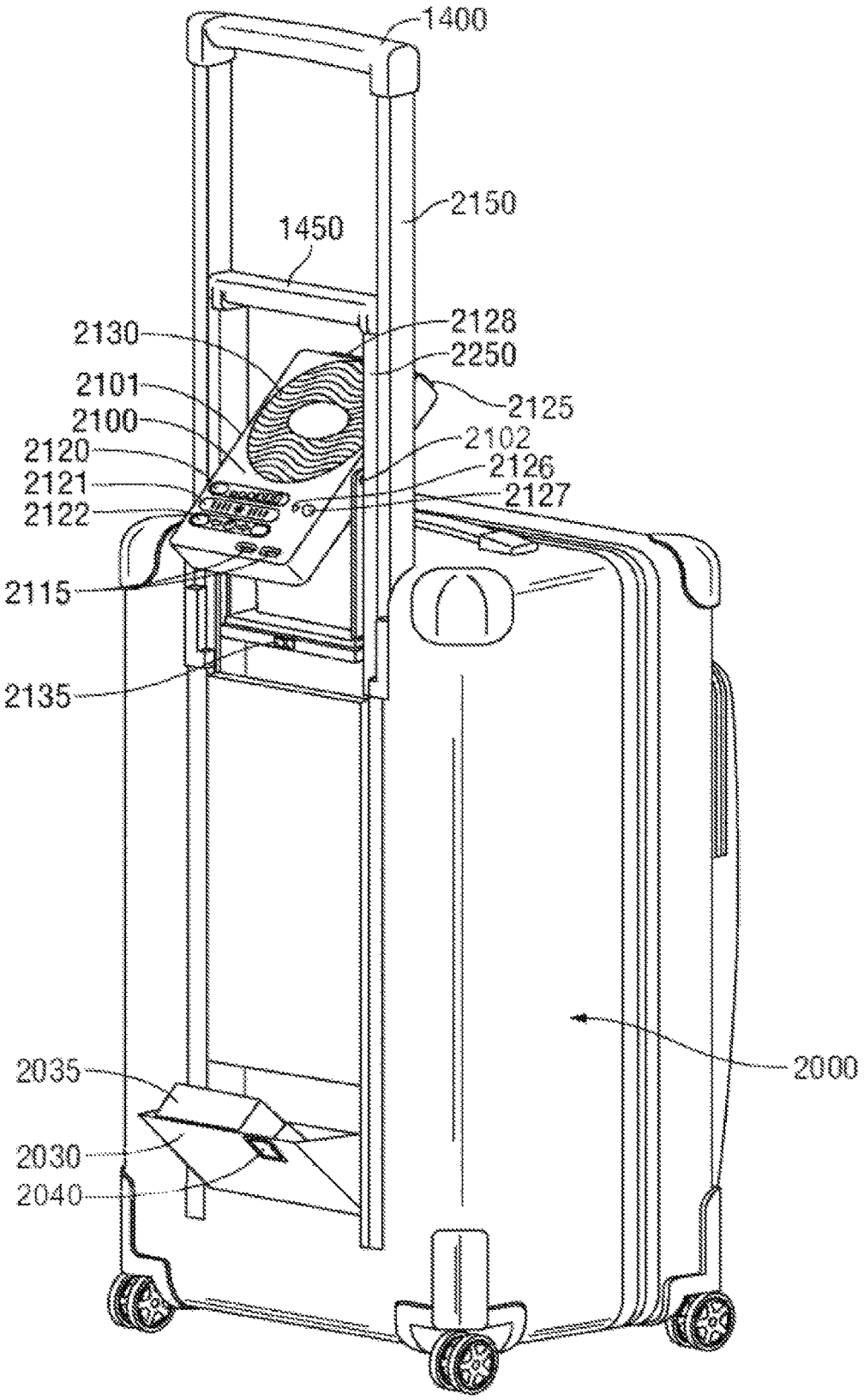
FIG. 12 is a partial side view of one embodiment of the present invention in which the fan hollow arms apparatus is extended from a suitcase.

FIG. 12 is a partial side view of one embodiment of the present invention in which the poles for the handles 1250 (FIG. 11) and poles for the fan handles 2250 are extended from the body of suitcase 2000. As shown, in several embodiments, fan 2100 can rotate about removeable pivot points, or detachable left-side pivot assembly 2101 and a detachable right-side pivot assembly 2102 such that the fan 2100 can rotate relative to poles for fan handles 2250. In several embodiments of the present invention, the fan 2100 can be removed entirely from the fan handles 2250 (FIG. 1). In several embodiments of the present invention, there is a release 2135 for removing the fan 2100 from the handle pole 2250.

In several embodiments, the present invention utilizes a control requirement—on when unit plugged is in, along with an LED 2127 (FIG. 11) helps to guide user to light on/off switch. In several embodiments the fan unit 2100 must be retractable allowing clear use of handle without exposing fan unit 2100. In several embodiments, the fan/light unit 2100 will recess/slide mount into protective case/area 2600 (FIG. 11) for optional use when ready. In several embodiments of the present invention, the fan unit 2100 should be easily detachable from suitcase body to be used independently. In several embodiments, the fan unit 2100 should pivot in handle 2250.

In several embodiments, there is a control 2120 on the fan 2100 with an "On/Off" capability and/or a variable speed setting. In several embodiments, the present invention contains an external AC/DC adapter 2035 in plug head (48" long—2 prong) UL Listed—built into storage area in bag with poka-yoke methodology to prevent omission when re-packing. In several embodiments, the present invention uses a protective fan blade cover or non-personal injury damaging blade design 2130 (See FIG. 11). In several embodiments, the fan 2100 uses a motion activated LED night light 2127 rated at adequate lumens to illuminate a walk/hotel area. In some embodiments, the fan 2100 has a power on light 2127. In some embodiments, the fan 2100 has a separate on/off switch 2128 for the LED light. In several embodiments, fan 2100 has USB ports 2115.

In several embodiments, the present invention utilizes vents on the fan 2100. In several embodiments, the present invention has motion sensor 2126 (FIG. 12) on the fan 2100. In several embodiments, the present invention utilizes a storage compartment pouch/door 2030 for battery storage on the back of the suitcase body 2000 (see FIG. 12). In several embodiments, the built-in storage compartment pouch/door 2030 for AC/DC cord storage and transport opens with a push touch open/close button. In several embodiments, storage compartment pouch/door 2030 is construed of durable plastic to withstand impacts. In several embodiments, the present invention utilizes increased strength handles 1250 (FIG. 11) to support backpacks and other slide-on bags (See FIG. 12). In several embodiments, the present invention utilizes a variable speed fan 2100 able to move 100-140 CFM at maximum speed. In several embodiments, door for storage compartment pouch/door 2030 can open with a push button 2040.

While preferred embodiments have been shown and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied. Accordingly, it is intended that the following claims be interpreted to embrace all such variations and modifications.

I claim:

1. A suitcase with a fan comprising:
a suitcase with a body;
said body further comprising:
a back with a back pouch with a pouch housing and telescoping arms capable of retracting in and out of the body of the suitcase and a handle bridging said telescoping arms;
a retractable cup holder attached to said body;
a fan;
said fan further comprising:
at least one rotating blade attached to a motor and a battery;
an On/Off switch;
a charging port;
a USB port;
a motion activated LED light; and
a detachable left-side pivot assembly and a detachable right-side pivot assembly; wherein
said detachable left-side pivot assembly with a detachable right-side pivot assembly can mechanically attach said fan between said telescoping arms; wherein
said detachable left-side pivot assembly and said detachable right-side pivot assembly permit removal of said fan from said telescoping arms.

2. The suitcase with a fan of claim 1 further comprising:
a pouch for storage on the back of said suitcase body.

3. The suitcase with a fan of claim 1 further comprising:
said fan further comprises:
a protective fan blade cover or non-personal injury damaging blade design.

4. The suitcase with a fan of claim 1 further comprising:
said back pouch can envelop said fan and the lower portion of said telescoping arms.

5. The suitcase with a fan of claim 1 further comprising:
a side pouch attached to said body for containing anti-bacterial wipes.

6. The suitcase with a fan of claim 5 further comprising:
said battery further comprises an external AC/DC adapter.

7. The suitcase with a fan of claim 1 further comprising:
said fan is moveable vertically about said telescoping arms by mechanical attachment and re-attachment of said detachable left-side pivot assembly and said detachable right-side pivot assembly to said telescoping arms.

8. The suitcase with a fan of claim 1 further comprising:
said body further comprises a bag expansion control.

9. The suitcase with a fan of claim 1 further comprising:
said fan can charge an electronic device through said USB port.

10. A suitcase with a rechargeable fan comprising;
a suitcase with a body;
said body further comprising:
a back with telescoping arms and a handle bridging said telescoping arms; said telescoping arms further comprising a hollow interior with slits running the length of said telescoping arms;
a grill vent for intake of air;
an enclosure in said body, wherein said telescoping arms extend into said enclosure;
a fan;
said fan further comprising:
a rotating blade attached to a motor and a rechargeable battery;
an On/Off switch;
a charging port; and
a USB port;
said fan is housed in said enclosure and in mechanical communication with said hollow interior of said telescoping arms, wherein once said On/Off switch is turned to on, air will be taken in through said grill into said hollow interior and pushed via movement of said rotating blades attached to said motor in said hollow interior of said telescoping arms and out of said slits running the length of said telescoping arm.

11. The suitcase with a rechargeable fan of claim 10 further comprising:
said fan is rechargeable through said charging port.

12. The suitcase with a rechargeable fan of claim 10 further comprising:
said fan can charge a device through said USB port.

13. A suitcase with a fan comprising:
a suitcase with a body;
said body further comprising:
a back with a back pouch with a pouch housing and telescoping arms capable of retracting in and out of the body of the suitcase with a handle bridging said telescoping arms; and
a retractable cup holder attached to said body;
a fan;
said fan further comprising:
at least one rotating blade attached to a motor and an AC/DC charging unit;
an On/Off switch;
a charging port;
a USB port;
a motion activated LED light; and
a detachable left-side pivot assembly and a detachable right-side pivot assembly; wherein
said detachable left-side pivot assembly and a detachable right-side pivot assembly can mechanically attach said fan between said telescoping arms; wherein said detachable left-side pivot assembly and a detachable right-side pivot assembly permit removal of said fan from said telescoping arms.

14. The suitcase with a fan of claim 13 further comprising:

a pouch for storage on the back of said suitcase body.

15. The suitcase with a fan of claim 13 further comprising:

said fan further comprises:

a protective fan blade cover or non-personal injury damaging blade design.

16. The suitcase with a fan of claim 13 further comprising:

said back pouch can envelop said fan and the lower portion of said telescoping arms.

17. The suitcase with a fan of claim 13 further comprising:

a side pouch attached to said body for containing antibacterial wipes.

* * * * *